US005889405A

United States Patent [19]

Yanai et al.

[11] Patent Number: 5,889,405

[45] Date of Patent: Mar. 30, 1999

[54] METHOD OF DETECTING FAULT IN ELECTROMAGNETICALLY-ACTUATED INTAKE OR EXHAUST VALVE

[75] Inventors: Akihiro Yanai; Takashi Izuo, both of Toyota, Japan

[73] Assignee: Toyota Jidosha Kabushiki Kaisha, Aichi, Japan

[21] Appl. No.: 862,707

[22] Filed: May 23, 1997

[30] Foreign Application Priority Data

May 28, 1996 [JP] Japan ..... 8-133633

[51] Int. Cl.[6] ..... G01R 31/02; F16K 31/02; F01L 9/04

[52] U.S. Cl. ..... 324/522; 324/418; 324/546; 324/207.16; 324/535; 123/90.11; 137/554; 361/154

[58] Field of Search ..... 324/522, 535, 324/546, 415, 418, 422, 423, 178–180, 207.13, 207.15, 207.16, 207.17, 207.2; 361/152, 154, 170; 137/551, 554; 123/90.11, 490; 251/129.01, 129.04

[56] References Cited

U.S. PATENT DOCUMENTS

| | | | |
|---|---|---|---|
| 4,614,170 | 9/1986 | Pischinger et al. | 123/90.11 |
| 4,809,742 | 3/1989 | Grau | 137/554 |
| 4,823,825 | 4/1989 | Buchl | 123/90.11 |
| 4,870,364 | 9/1989 | Trox et al. | 324/418 |
| 5,109,675 | 5/1992 | Hwang | 251/129.04 |
| 5,424,637 | 6/1995 | Oudyn et al. | 324/207.16 |
| 5,450,270 | 9/1995 | Takahashi | 361/154 |
| 5,477,149 | 12/1995 | Spencer et al. | 324/418 |

FOREIGN PATENT DOCUMENTS

| | | |
|---|---|---|
| 0717172 | 6/1996 | European Pat. Off. . |
| 19530394 | 2/1997 | Germany . |
| 60-122253 | 6/1985 | Japan . |
| 61-250309 | 11/1986 | Japan . |
| 7-224624 | 8/1995 | Japan . |

*Primary Examiner*—Diep N. Do
*Attorney, Agent, or Firm*—Kenyon & Kenyon

[57] ABSTRACT

A method of detecting a fault of an electromagnetically-actuated intake/exhaust valve is disclosed. A valve body is supported in neutral position by the energizing force of an elastic member, and the electromagnetic force generated by supplying a current to the coils arranged on the two sides of a plunger is applied to the plunger thereby to operate the valve. A fault is detected based on a change of the current flowing in one coil attracting and holding the plunger with the inductance change of the same coil when the plunger is switched from the position of the same coil to the position of the other coil. This method improves the fault detection accuracy for the electromagnetically-actuated intake/exhaust valve over the prior art.

4 Claims, 11 Drawing Sheets

METHOD OF DETECTING FAULT IN ELECTROMAGNETICALLY-ACTUATED INTAKE OR EXHAUST VALVE

BACKGROUND OF THE INVENTION

1. Field of the Invention

The present invention relates to an electromagnetically-actuated valve used as a fuel intake or exhaust emission valve of an internal combustion engines, or more in particular to a method of detecting a fault in such an electromagnetically-actuated valve.

2. Description of the Related Art

The conventional intake/exhaust valve of an internal combustion engine is generally operated by a camshaft driven based on the rotation of a crankshaft. In order to achieve an optimum valve operation time in accordance with the operating conditions and thereby improve the performance of the internal combustion engine, various variable mechanisms for the valve gear system including a two-stage switching system (on/off control system) and a continuously variable system have been developed for practical applications. Some of these variable mechanisms displace the rotational phase of the camshaft and others comprise a plurality of cam profiles of the camshaft.

With the above-mentioned intake/exhaust valves driven by the camshaft, however, all of the valve lift, the valve-open time length and the valve operation timing cannot be set independently and arbitrarily. In an effort to meet the demand for a higher performance of internal combustion engines in recent years, a research effort has vigorously been made to develop an electromagnetically-actuated valve gear system in which these parameters can be set to an ideal value in accordance with the operating conditions.

For example, JP-A-61-250309 (corresponding to U.S. Pat. No. 4,823,825) describes an electromagnetically-actuated valve having a structure in which a valve body supported at the neutral position by an energizing force of a pair of springs is moved from the neutral position to full open or full close position by exerting the electromagnetic force on a plunger coupled to the valve body. The same patent especially discloses a method of detecting a fault of this type of valve. The fault detection method comprises the steps of monitoring the change in the current flowing in a coil when power is supplied to the electromagnetically-actuated valve, deciding that the valve operates normally when the current decreases during a predetermined period, and a deciding that the valve operation is faulty when the current does not decrease during such a period.

The reason of the current decrease is described below. The magnetic flux, i.e., the circuit inductance, is inversely proportional to the square of the distance between the plunger and the core of the electromagnet, and theoretically suddenly increases immediately before the plunger touches the core. With an increase in the magnetic flux, the counter electromotive force e increases according to the formula $$e=-d\psi/dt=-N(d\Phi/dt)=-L(di/dt)$$

$$\psi=N\Phi$$

where $\psi$ is the number of flux interlinkages, $\Phi$ is the magnetic flux, N is the number of turns, L is the inductance, i is the current and t is the time. The source voltage thus is substantially offset by the counter electromotive force and is not substantially used for supplying current, resulting in a decreased current.

This phenomenon, however, does not always occur. Depending on the hardware configuration including the material and geometry, for example, the magnetic fluxes may saturate at an early time. In such a case, even if the plunger is normally attracted to the core, the current may not decrease. Also, in the final positional control operation for decreasing the current immediately before the plunger almost touches the core, the current may not decrease.

SUMMARY OF THE INVENTION

In view of this situation, the object of the invention is to provide a method of detecting a fault in an electromagnetically-actuated intake/exhaust valve with an accuracy improved over the prior art.

In order to achieve the above-mentioned object, according to a first aspect of the invention, there is provided a method of detecting a fault of an electromagnetically-actuated intake/exhaust valve, in which a valve body is elastically supported at the neutral position by the energizing force of an elastic member, and the electromagnetic force generated by supplying current to the coils arranged on the two sides of a plunger integrated with the valve body is exerted on the plunger thereby to operate the valve, the method comprising the steps of (a) switching the plunger position from a first coil attracting and holding the plunger to a second coil, (b) detecting the change in the current flowing in the first coil with the inductance change of the first coil during the execution of step (a), and (c) detecting a fault on the basis of the current change detected in step (b).

According to a second aspect of the invention, there is provided a method of detecting a fault of an electromagnetically-actuated intake/exhaust valve, in which the step (c) described above preferably includes the step of detecting a fault on the basis of the time delay from the time point when a command current to a coil drive circuit is changed in order to reduce the current value flowing in the first coil by a predetermined amount to the time point when the actual current flowing in the first coil reaches a predetermined value corresponding to the change in the command current value.

According to a third aspect of the invention, there is provided a method of detecting a fault of an electromagnetically-actuated intake/exhaust valve, in which the step (c) described above preferably includes the step of detecting a fault on the basis of the difference between the command current value applied to the coil drive circuit for reducing the current flowing in the first coil by a predetermined amount and the actual current flowing in the coil.

According to a fourth aspect of the invention, there is provided a method of detecting a fault of an electromagnetically-actuated intake/exhaust valve, in which a valve body is elastically supported at the neutral position by the energizing force of an elastic member, and the electromagnetic force generated by supplying current to the coils arranged on the two sides of a plunger integrated with the valve body is exerted on the plunger thereby to operate the valve, the method comprising the steps of (a) switching the plunger position from a first coil attracting and holding the plunger to a second coil, (b) detecting the rise time of the current flowing in the second coil in step (a), and (c) detecting a fault on the basis of the rise time detected in step (b).

When the valve operation is faulty, the plunger fails to be attracted to the neighborhood of the coils and the resulting increased air gap reduces the coil inductance, resulting in an improved ability of the current flowing in the coils to follow the command current. In the above-mentioned fault detection method for an electromagnetically-actuated intake/exhaust valve according to the first, second and third aspects of the invention, the ability of the actual coil current to follow the command current when transferring from the attracted and held state to the released state, i.e., the response delay and the response current value are determined thereby to detect a fault in the valve operation. The coil for attraction and holding is supplied with a predetermined current for holding, and the current value switched for releasing the attraction is also predetermined. This facilitates the comparison between the actual current value and the command current value, thereby making possible a highly accurate fault detection without any fault detection unit.

In the case where the plunger fails to reach a new position of the new attracting coil due to the loss of synchronism or the like when the plunger attraction is switched from one coil to the other, the small inductance of the attracting coil and hence a high ability of the coil current to follow the command current causes the coil current to rise sharply. In the fault detection method for the electromagnetically-actuated intake/exhaust valve according to the fourth aspect of the invention described above, the presence or absence of a fault of valve operation such as the loss of synchronism can be detected by detecting the rise time and therefore the need for an independent fault detection unit is eliminated.

BRIEF DESCRIPTION OF THE DRAWINGS

Further features and advantages of the present invention will be apparent from the following description with reference to the accompanying drawings, in which:

FIGS. 7B and 7D are time charts showing the valve lift for the respective cases, in which FIGS. 7A and 7B represent the normal operation, and FIGS. 7C and 7D represent the operation at the time of loss of synchronism;

FIGS. 8B and 8D are time charts showing the valve lift for the respective cases, in which FIGS. 8A and 8B represent the normal operation, and FIGS. 8C and 8D represent the operation at the time of loss of synchronism;

FIGS. 9B and 9D are time charts showing the valve lift for the respective cases, in which FIGS. 9A and 9B represent the normal operation, and FIGS. 9C and 9D represent the operation at the time of loss of synchronism;

DESCRIPTION OF THE PREFERRED EMBODIMENTS

Now, embodiments of the present invention will be described with reference to the accompanying drawings.

Figure 1:
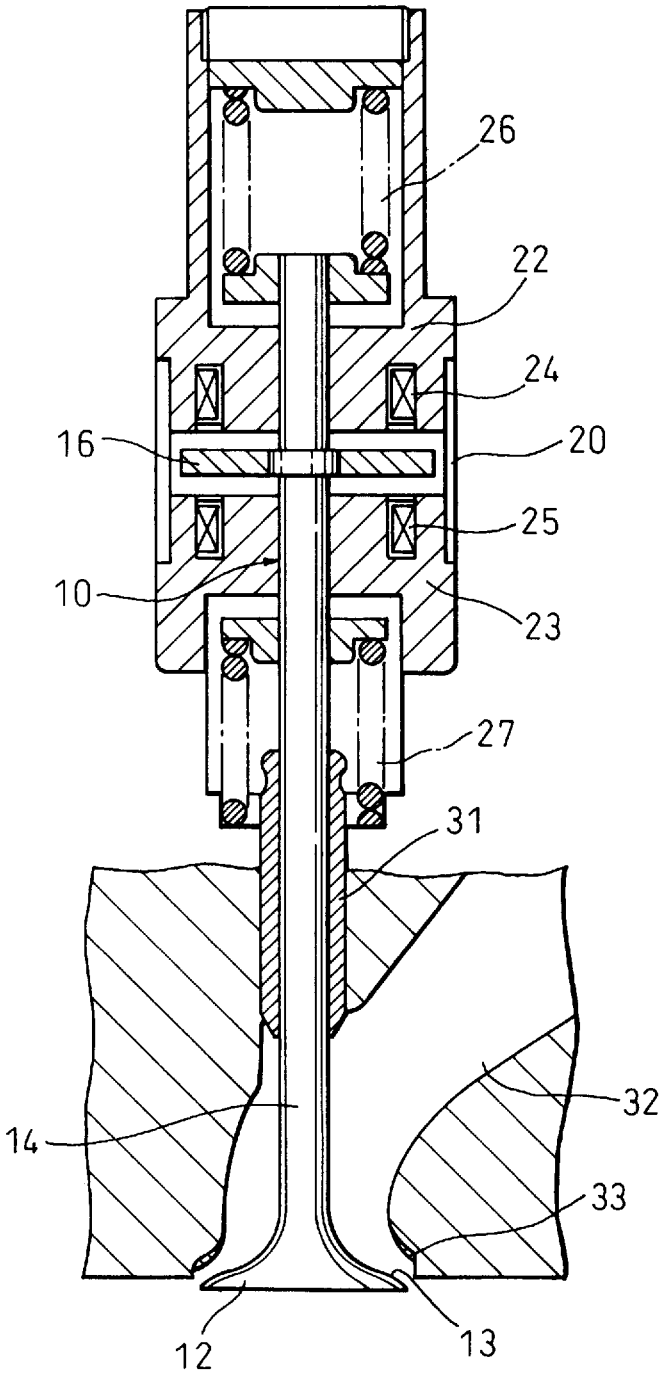
FIG. 1 is a longitudinal sectional view of an electromagnetically-actuated intake/exhaust valve according to an embodiment of the invention.

FIG. 1 is a longitudinal sectional view showing an electromagnetically-actuated intake/exhaust valve according to an embodiment of the invention. A valve body 10 shown in FIG. 1 includes a valve head 12 and a valve stem 14. The valve face 13 of the valve head 12 is seated on or leaves a valve seat 33 formed in an intake/exhaust port 32 of an internal combustion engine thereby to operate the intake/exhaust port 32. The valve stem 14 of the valve body 10 is held slidably in axial direction by a valve guide 31. A plunger 16 is fixed on the valve stem 14.

The plunger 16 is made of a circular disk member composed of a soft magnetic material. An upper core 22 is arranged above the plunger 16 in a predetermined spaced relationship with the plunger 16, and a lower core 23 is arranged under the plunger 16 in a predetermined spaced relationship with the plunger 16. The upper core 22 and the lower core 23 are composed of a soft magnetic material and held in predetermined relative positions by a case 20 made of a nonmagnetic material. An upper coil 24 is held in the upper core 22, and a lower coil 25 is held in the lower core 23.

The valve stem 14 is supported in the direction thereof by an upper spring 26 and a lower spring 27. The upper spring 26 and the lower spring 27 are balanced in force with each other in such a manner that the position (neutral position) of the plunger 16 is intermediate between the upper core 22 and the lower core 23 when neither the upper coil 24 nor the lower coil 25 is supplied with power. As long as the plunger 16 is at neutral position, the valve body 10 assumes a position intermediate between a full-open displaced end and a full-closed displaced end.

With this configuration, a magnetic circuit is generated around the upper coil 24 through the upper core 22 and the plunger 16 and the air gap formed between the upper core 22 and the plunger 16. Consequently, when a current flows in the upper coil 24, magnetic fluxes circulate in the magnetic circuit and an electromagnetic force is generated in such a direction as to reduce the air gap, i.e., in such a direction as to displace the plunger 16 upward. On the other hand, a magnetic circuit is generated around the lower coil 25 through the lower core 23 and the plunger 16 and the air gap formed between the lower core 23 and the plunger 16. When a current flows in the lower coil 25, therefore, an electromagnetic force is generated similarly in such a direction as to displace the plunger 16 downward. The plunger 16 can thus be vertically reciprocated, that is, the valve body 10 can be driven alternately in opening and closing directions by supplying a current to the upper coil 24 and the lower coil 16 alternately.

Figure 2:
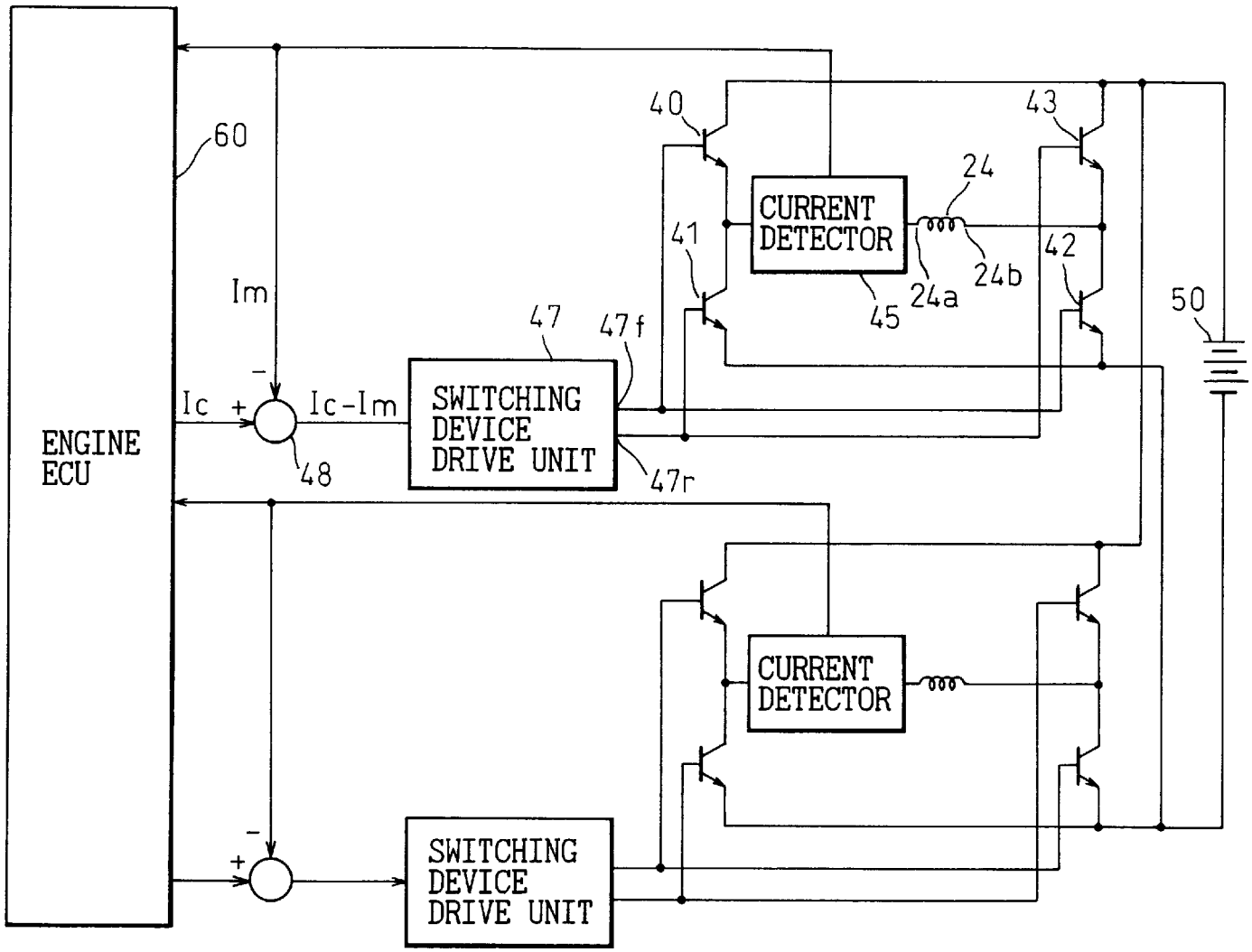
FIG. 2 is a diagram showing a drive circuit of an electromagnetically-actuated valve according to an embodiment of the invention.

FIG. 2 is a circuit diagram showing an example of circuit configuration for driving the electromagnetically-actuated valve shown in FIG. 1. As shown in FIG. 1, the components associated with the upper coil 24 and the components associated with the lower coil 25 have the same circuit configuration. A description, therefore, will only be given about the components associated with the upper coil 24.

A first terminal 24*a* of the upper coil 24 is connected to the emitter terminal of a forward switching device 40 composed of an NPN transistor and the collector terminal of a reverse switching device 41 composed of an NPN transistor. A second terminal 24*b* of the upper coil 24, on the other hand, is connected to the collector terminal of a forward switching device 42 composed of an NPN transistor and the emitter terminal of a reverse switching device 43 similarly composed of an NPN transistor.

The collector terminal of the forward switching device 40 and the collector terminal of the reverse switching device 43 are both connected to the positive terminal of a power supply 50. The emitter terminal of the reverse switching device 41 and the emitter terminal of the forward switching device 42 are both connected to the negative terminal of the power supply 50. Further, the base terminals of the forward switching devices 40 and 42 are both connected to the forward output terminal 47*f* of a switching device drive circuit 47. In similar fashion, the base terminals of the reverse switching devices 41 and 43 are both connected to the reverse output terminal 47*r* of the switching device drive circuit 47.

The actual current Im flowing in the upper coil 24 is detected by a coil current detection circuit 45, and the output signal of the coil current detection circuit 45 is applied to the negative terminal of a subtraction circuit 48. The positive terminal of the subtraction circuit 48 is supplied with a coil command current value Ic output from an engine electronic control unit (engine ECU) 60. The output Ic-Im of the subtraction circuit 48 is applied to the switching device drive circuit 47.

The switching device drive circuit 47 includes therein a triangular wave oscillation circuit for generating a triangular wave of a predetermined period and a comparator circuit for comparing the triangular wave with the input signal Ic-Im. The switching device drive circuit 47 thus generates a PWM pulse signal regulated to a duty factor corresponding to the magnitude of the input signal Ic-Im. As long as the signal Ic-Im is positive in value, the switching device drive circuit 47 outputs a PWM pulse of a duty factor corresponding to the magnitude thereof from the forward output terminal 47*f*. When the signal Ic-Im is negative in value, in contrast, a PWM pulse signal having a duty factor corresponding to the magnitude thereof is output from the reverse output terminal 47*r*.

In the case where the input signal Ic-Im is positive, therefore, the two forward switching devices 40 and 42 are turned on with a duty factor corresponding to the signal Ic-Im. When the input signal Ic-Im is negative in value, on the other hand, the two reverse switching devices 41 and 43 are turned on with a duty factor corresponding to the current Ic-Im. In the process, the forward switching devices 40, 42 never turn on at the same time as the reverse switching devices 41, 43. The signal Ic-Im thus is controlled to become zero in value by the switching device drive circuit 47. The actual current Im flowing in the upper coil 24, therefore, can be rendered to coincide accurately with the command current value Ic, thereby making it possible to produce a characteristic stable against the variations of the source voltage and the circuit characteristics.

Figure 3A:
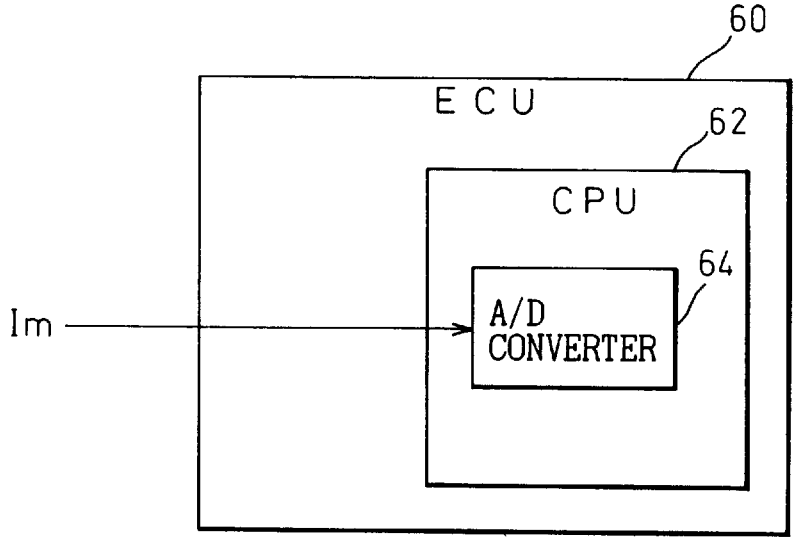
FIGS. 3A and 3B are diagrams illustrating a processing circuit for an actual coil current (monitor current) Im.
Figure 3B:
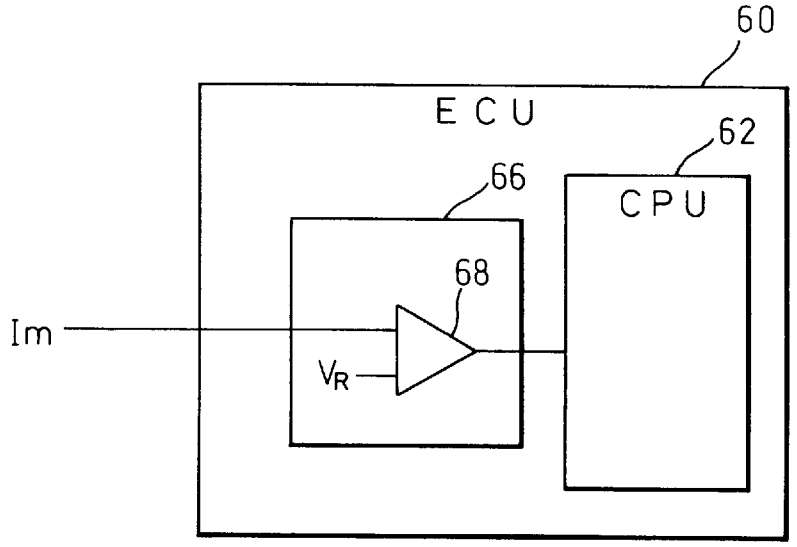

Further, the output of the coil current detection circuit 45 is applied to the engine ECU 60, which uses the actual current Im flowing in the coils 24, 25 for detecting a fault of the electromagnetically-actuated valve, as described later. The output signal Im of the coil current detection circuit 45 is an analog signal having a voltage value corresponding to the actual current flowing in the coils. As shown in FIG. 3A, therefore, this signal is supplied to an A/D converter 64 which can be built in a CPU (central processing unit) 62 in the ECU 60. Nevertheless, the A/D conversion is a process which generally consumes a considerable time and undesirably increases the cost. This trend is promoted with the increase in the number of actuators, i.e., electromagnetically-actuated valves involved, resulting in an increased need of improving the processing performance of the CPU and hence a further increased cost. In view of this, in the case where the only need is to decide whether or not the coil current Im is larger than a predetermined threshold value, the same effect is obtained by adding a fail decision circuit 66 having a comparator 68 for comparing the voltage signal Im representing the coil current with a predetermined threshold voltage value $V_R$, as shown in FIG. 3B, and applying a digital output signal thereof to the CPU 62.

Figure 4:
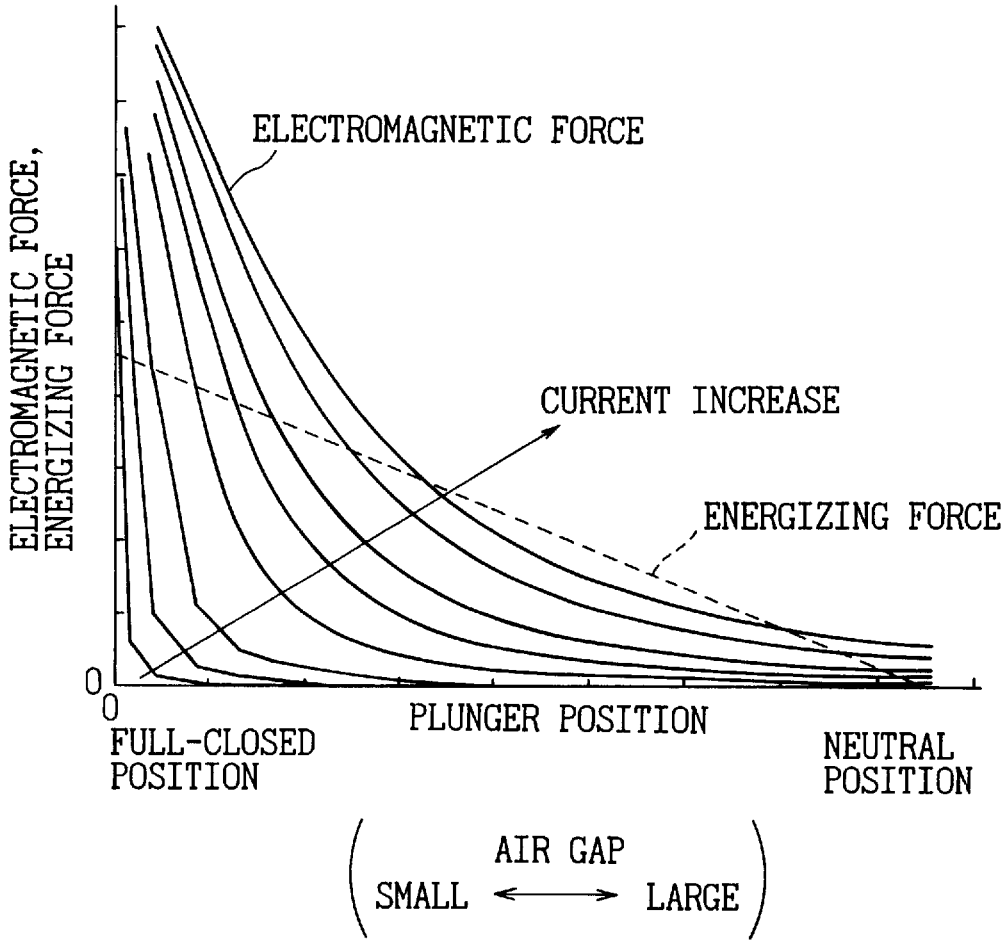
FIG. 4 is a diagram showing the relation between the plunger position and the electromagnetic force (attraction) exerted by an upper electromagnet on the plunger, with the upper coil current as a parameter (solid line), and the relation between the plunger position and the energizing force exerted by a pair of springs on the plunger (dashed line)

In FIG. 4, a plurality of curves denoted by solid lines represent the relation between the position of the plunger 16 (with the position contacting the upper core 22 set as zero) and the electromagnetic force (attraction) exerted on the plunger 16 by the electromagnet associated with the upper coil 22, with the value of the current flowing in the upper coil 24 as a parameter. As indicated by these curves, the electromagnetic force (attraction) exerted on the plunger rapidly increases with the approach of the valve body 10 to the full-closed displaced end. The dashed straight line shown in FIG. 4 similarly represents the relation between the position of the plunger 16 and the energizing force (on the lower core 23 side) exerted by the upper spring 26 and the lower spring 27 on the valve body 10. As seen from this straight line, the energizing force simply increases linearly even when the valve body 10 approaches the full-closed displaced end. This is also the case with the electromagnetic force exerted by the electromagnet on the lower core 23 as shown in FIG. 4, from which it is seen that the full-closed position is simply replaced by the full-open position. Consequently, the closer the full-open position or the full-closed position, the smaller the current required for producing an electromagnetic force larger than the energizing force as compared with the force required at neutral position. Explanation will be made below about a method of driving an electromagnetically-actuated valve taking into consideration the above-mentioned characteristics of the electromagnetic force and the energizing force.

Figure 5A:
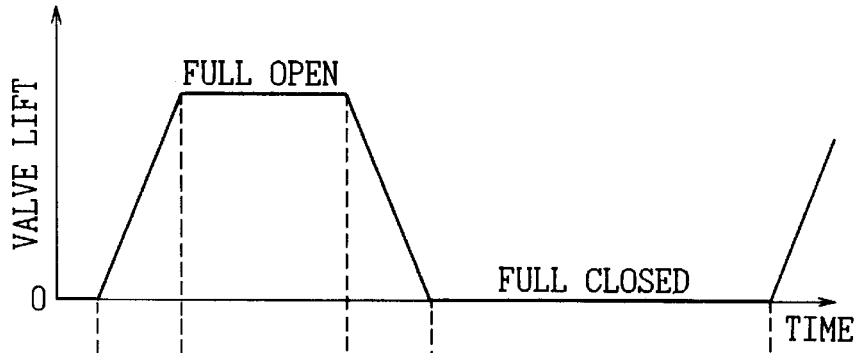
FIGS. 5A, 5B and 5C show example time charts showing a valve lift, an upper coil command current and a lower coil command current, respectively.
Figure 5B:
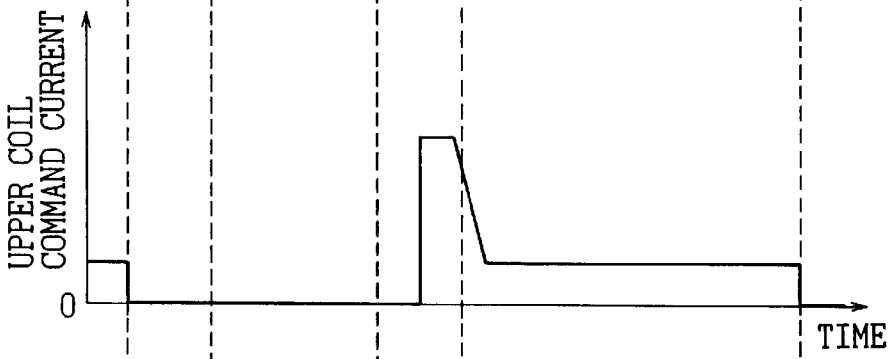
Figure 5C:
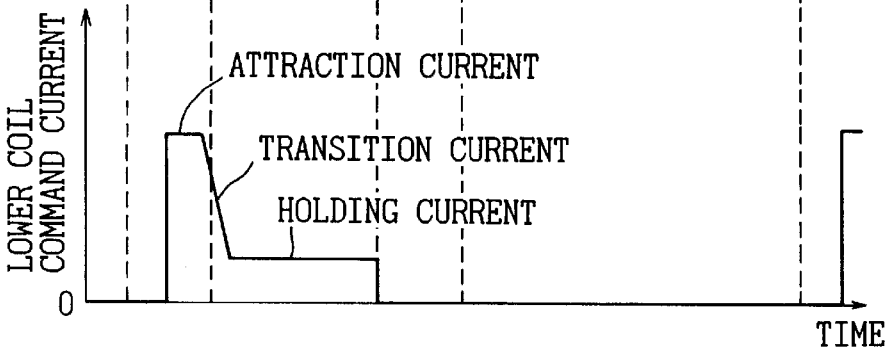

FIGS. 5A, 5B and 5C are time charts showing the valve lift, the upper coil command current and the lower coil command current, respectively. In the full-closed state, as shown in FIG. 5B, the upper coil 24 is supplied with a minimum current (hereinafter referred to as "the holding current") required for the upper coil 22 to attract and hold the plunger 16. When the valve is to be opened, first, the holding current stops being supplied. Then, the valve body 10 moves toward the full-open position by the simple harmonic oscillation (free oscillation) of a spring mass system. The friction loss between the valve stem 14 and the valve guide 31 and the internal friction loss of the springs, however, attenuates the amplitude of the movement of the valve body 10 as compared with the ideal case. The current therefore is supplied to the lower coil 25 at a predetermined timing. This current can be divided into three categories including an attraction current, a transition current and a holding current.

Specifically, first, the attraction current is supplied for moving the plunger 16. Then, considering the characteristic of FIG. 4 described above, the transition current decreasing at a given chronologically changing rate is supplied to attract the plunger 16 with a weakened electromagnetic force (attraction force). After attracting the plunger 16, a minimum current required for attracting and holding the valve body 10, i.e., the holding current is supplied. Similarly, in the process of closing the valve from the full-open state, first, the holding current stops being supplied to the lower coil 25, and the upper coil 24 is supplied with the attraction current, the transition current and the holding current in that order. In this way, the electromagnetically-actuated intake/exhaust valve according to this embodiment is so configured that the movement of the valve body is controlled by reducing the current value immediately before the valve body reaches the full-open position or the full-closed position.

Figure 6A:
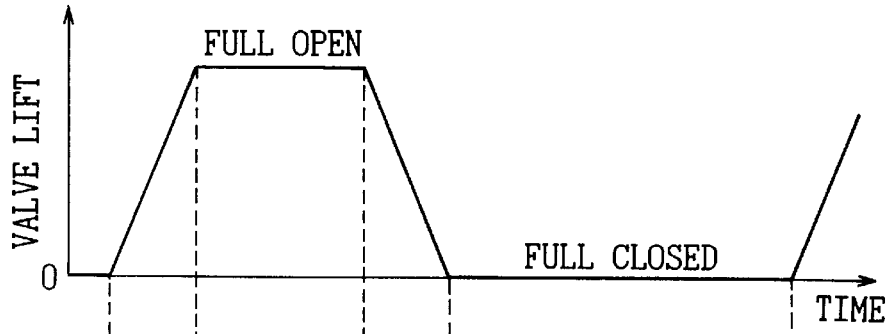
FIGS. 6A, 6B and 6C show another example time charts showing a valve lift, an upper coil command current and a lower coil command current, respectively.
Figure 6B:
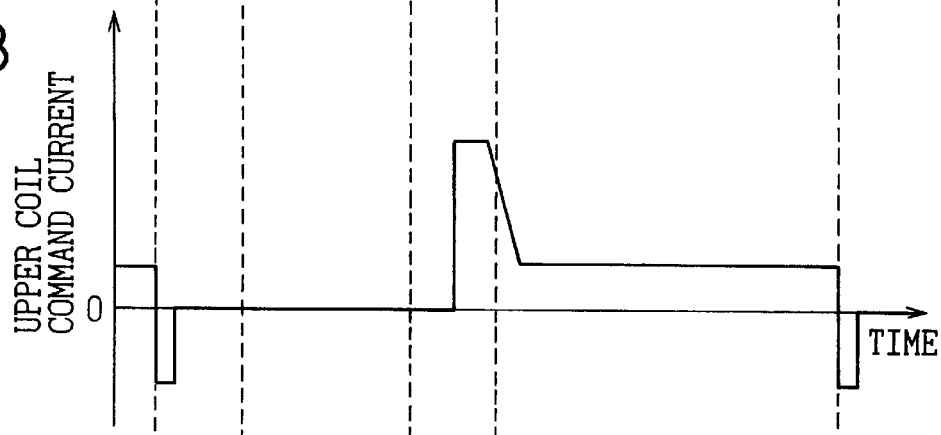
Figure 6C:
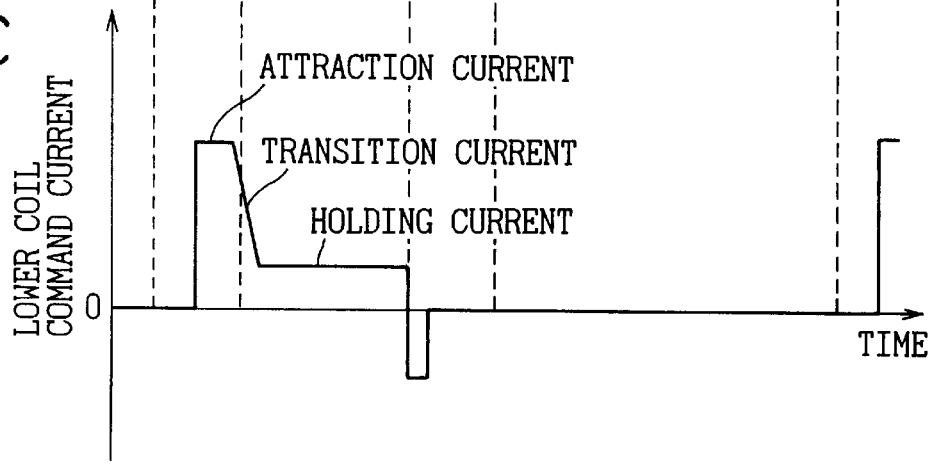

For the free oscillation to be effected with a satisfactory response upon release of the plunger attraction, it is essential to extinguish the residual magnetic field in the core. For this purpose, at the time of releasing the attraction and holding of the plunger, a negative command current value as shown in FIGS. 6B and 6C is supplied effectively but the command current value is not as shown in FIGS. 5B and 5C, thereby supplying the coil current in the direction opposite to the coil current for the attraction and holding of the plunger.

Now, in supplying a current i to the coils, a counter electromotive force e described below is generated at the transient period, as described above.

$$e=-d\psi/dt$$

$$\psi=N\Phi$$

where $\psi$ is the number of flux interlinkages, N is the number of turns, and $\Phi$ is the magnetic flux. This counter electromotive force is applied in such a direction as to decrease a current tending to increase and to increase a current tending to decrease. The counter electromotive force therefore retards the actual current following the command current.

The inductance L, which changes with the magnitude of the air gap between the plunger and the cores, increases with the decrease in the air gap. In other words, as long as the electromagnetically-actuated valve operates normally, less current flows and therefore the actual current follows the command current more slowly in a region with a smaller air gap. When the synchronism is lost, on the other hand, a current flows in a region with a somewhat large air gap, so that the actual current follows the command current more rapidly. According to this invention based on this knowledge, the ability of the actual current to follow the command current is monitored thereby to decide the normality or abnormality of the operation of an electromagnetically-actuated value.

Figure 7A:
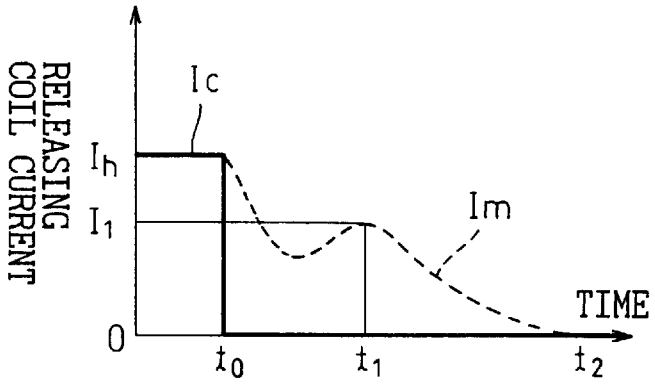
FIGS. 7A and 7C are time charts showing waveforms of a command current (solid line) for the releasing coil and an actual current Im (dotted line) flowing when the command current Ic is changed from a holding current value $I_h$ to 0 to release the attraction and holding of the plunger.
Figure 7B:
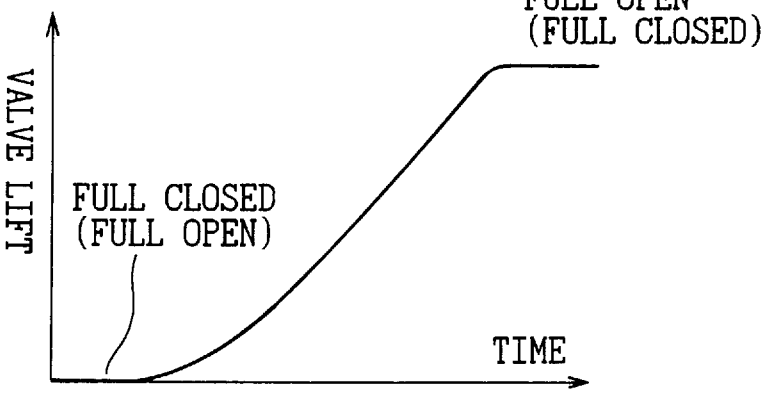
Figure 7C:
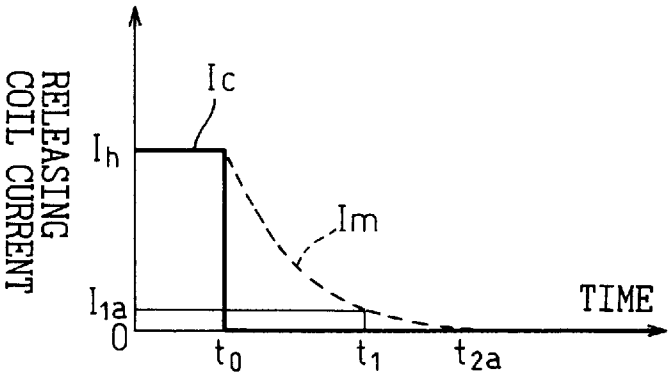
Figure 7D:
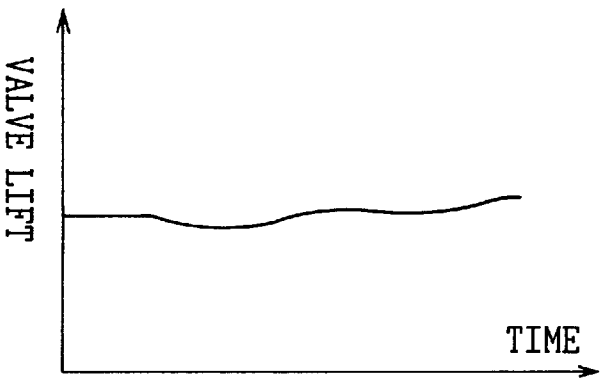

FIGS. 7A and 7C are time charts showing waveforms of a command current Ic (solid line) and an actual current (dotted line) flowing when the command current Ic on the attracting and holding coil (releasing coil) is changed from an, the holding current value $I_h$ to zero as shown in FIG. 5B or 5C in order to release the attraction and holding of the plunger, and FIGS. 7B and 7D are time charts showing the valve lift in the process. In these drawings, FIGS. 7A and 7B represent the normal operation, and FIGS. 7C and 7D represent the operation at the time of loss of synchronism. In the case where Ic is reduced to zero at time point $t_0$, the actual current Im gradually decreases under normal conditions, and soon begins to be increased by the counter electromotive force and reaches a local maximum $I_1$, at time point $t_1$, followed by beginning to decrease until the command current value reaches zero at time point $t_2$.

At the time of loss of synchronism, however, the actual current never increases but follows the command current and reaches zero at time point $t_{2a}$ earlier than time point $t_2$. The time $t_2-t_0$ to required for the actual current Im to reach zero in accordance with the change of the command current Ic from the holding current value $I_h$ to zero is measured and compared with a predetermined threshold value. If the measurement is not higher than the threshold value, an abnormality or a fault can be decided. Also, the actual current Im, which assumes a comparatively large value $I_1$ under normal conditions as described above, takes a considerably smaller value $I_{1a}$ at the time of loss of synchronism. In view of this, a fault can be decided by measuring the actual current value $I_1$ in the neighborhood of the time point $t_1$, comparing it with a predetermined threshold value and deciding that it is not higher than the threshold value.

Figure 8A:
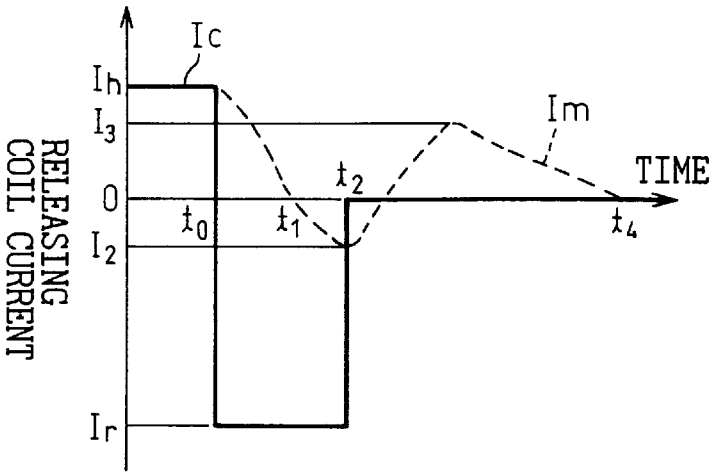
FIGS. 8A and 8C are time charts showing waveforms of a command current Ic (solid line) for the releasing coil and an actual current Im (dotted line) flowing when the command current Ic is changed from a holding current value $I_h$ to a negative current value $I_r$ temporarily and then increased to 0 to release the attraction and holding of the plunger.
Figure 8B:
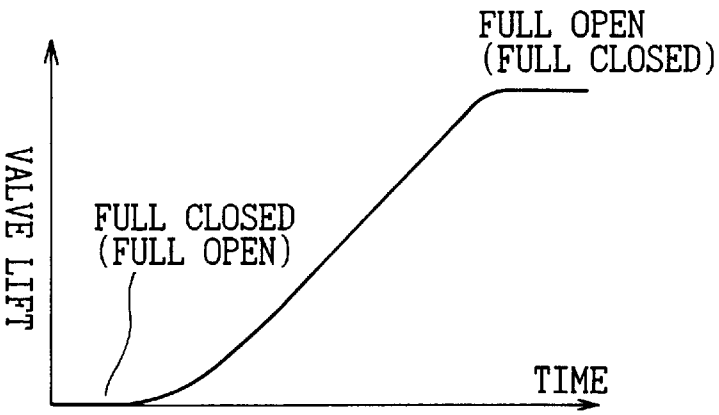
Figure 8C:
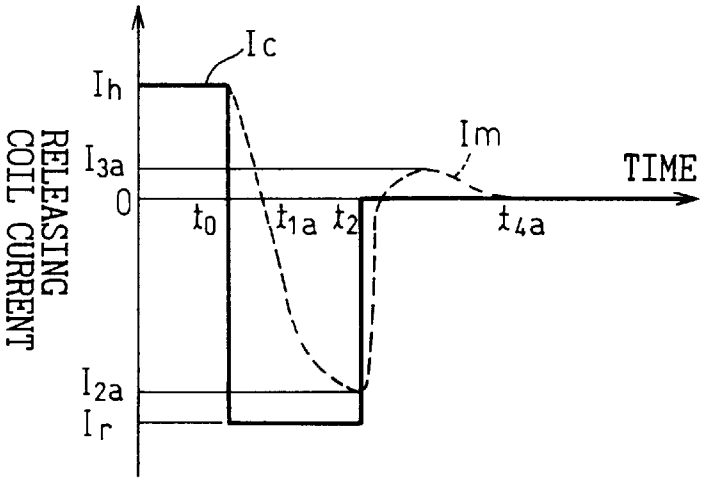
Figure 8D:
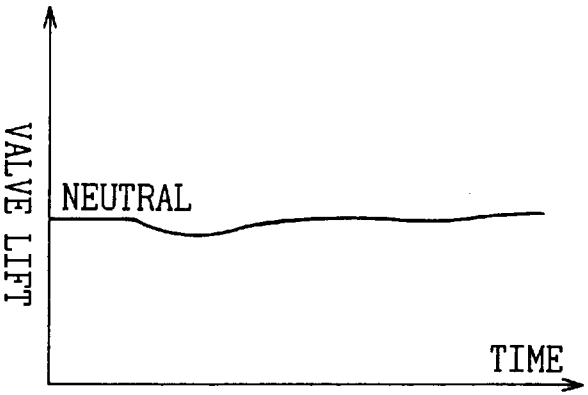

FIGS. 8A and 8C are time charts showing waveforms of a command current Ic (solid line) and an actual current (dotted line) flowing when the command current Ic on the releasing coil is changed to a negative current value Ir from the holding current value $I_h$ temporarily and then increased to zero as shown in FIG. 6B or 6C similarly in order to release the attraction and holding of the plunger, and FIGS. 8B and 8D are time charts showing the valve lift in the process. In these drawings, FIGS. 8A and 8B represent the normal operation, and FIGS. 8C and 8D represent the operation at the time of loss of synchronism. The time point $t_1$ when the current first reaches 0 is advanced to $t_{1a}$ at the time of a fault. Also, the time $t_4$ when the actual current finally reaches 0 is advanced to $t_{4a}$. For grasping the ability of the actual current to follow the command current in terms of time delay, $t_1-t_0$ or $t_4-t_0$ is measured and compared with a predetermined threshold value. If these values are not more than the threshold value, a fault is decided.

The difference $I_2-I_r$ between the command current value $I_r$ and the actual current value $I_2$ at time point $t_2$ is lower at the time of a fault than under normal conditions as shown as $I_{2a}-I_r$ in FIG. 8C. Also, a current $I_3$ generated by the counter electromotive force is reduced at the time of a fault as compared with the corresponding current under the normal conditions as shown as $I_{3a}$ in FIG. 8C. If the ability of the actual current to follow the command current is to be detected as a difference between the command current value and the actual current value, the value $I_2-I_r$ or $I_3$ is measured and compared with a predetermined threshold value, so that if the result of comparison is not more than the threshold value, a fault is detected.

Figure 9C:
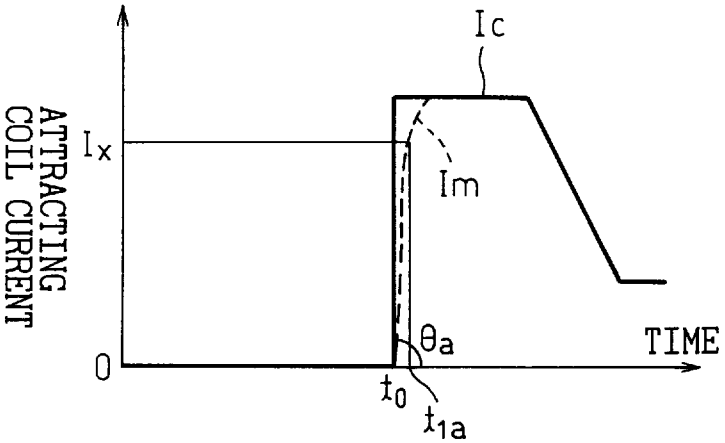
FIGS. 9A and 9C are time charts showing waveforms of a command current Ic (solid line) for the attracting coil and an actual current Im (dotted line) flowing when the command current Ic is changed from 0.
Figure 9D:
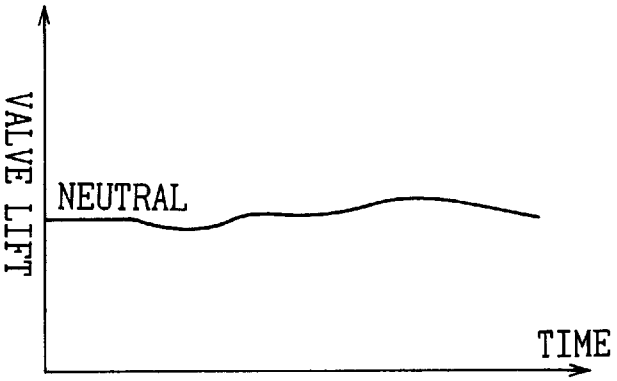
Figure 9A:
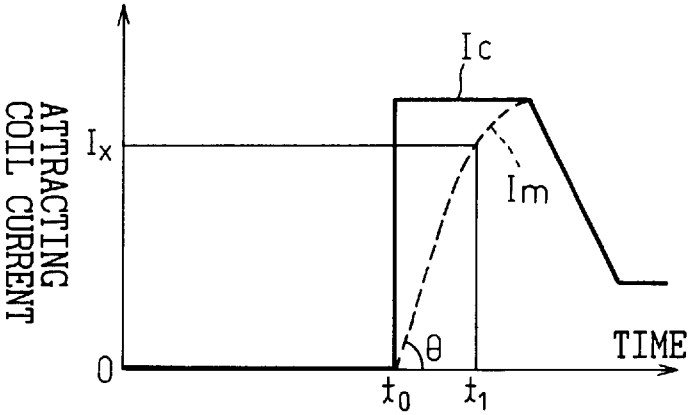
Figure 9B:
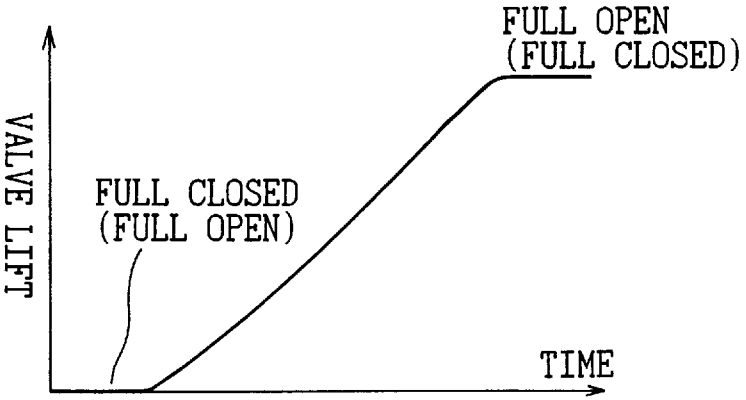

FIGS. 9A and 9C are time charts showing waveforms of a command current Ic (solid line) in the second coil (attracting coil) and an actual current (dotted line) Im flowing when the command current Ic is changed from zero in order to start the attraction of the plunger by the second coil, and FIGS. 9B and 9D are time charts showing the valve lift in the process. In these drawings, FIGS. 9A and 9B represent the normal operation, and FIGS. 9C and 9D represent the operation at the time of loss of synchronism. Under normal conditions, the circuit inductance causes the actual current Im to rise slowly at a slope of θ. Once the synchronism is lost, however, the failure of the plunger to reach the neighborhood of the attracting coil reduces the circuit inductance, so that the actual current Im rises sharply (slope angle $\theta_a > \theta$). In view of this, this slope θ is measured and compared to a predetermined threshold value, and if the difference is not less than the threshold value, a fault can be decided. In place of the slope θ, the time $t_1 - t_0$ required to reach a predetermined current value $I_x$ can be measured and compared with a predetermined threshold value, so that if the difference is not more than the threshold value, a fault can be decided.

Figure 10:
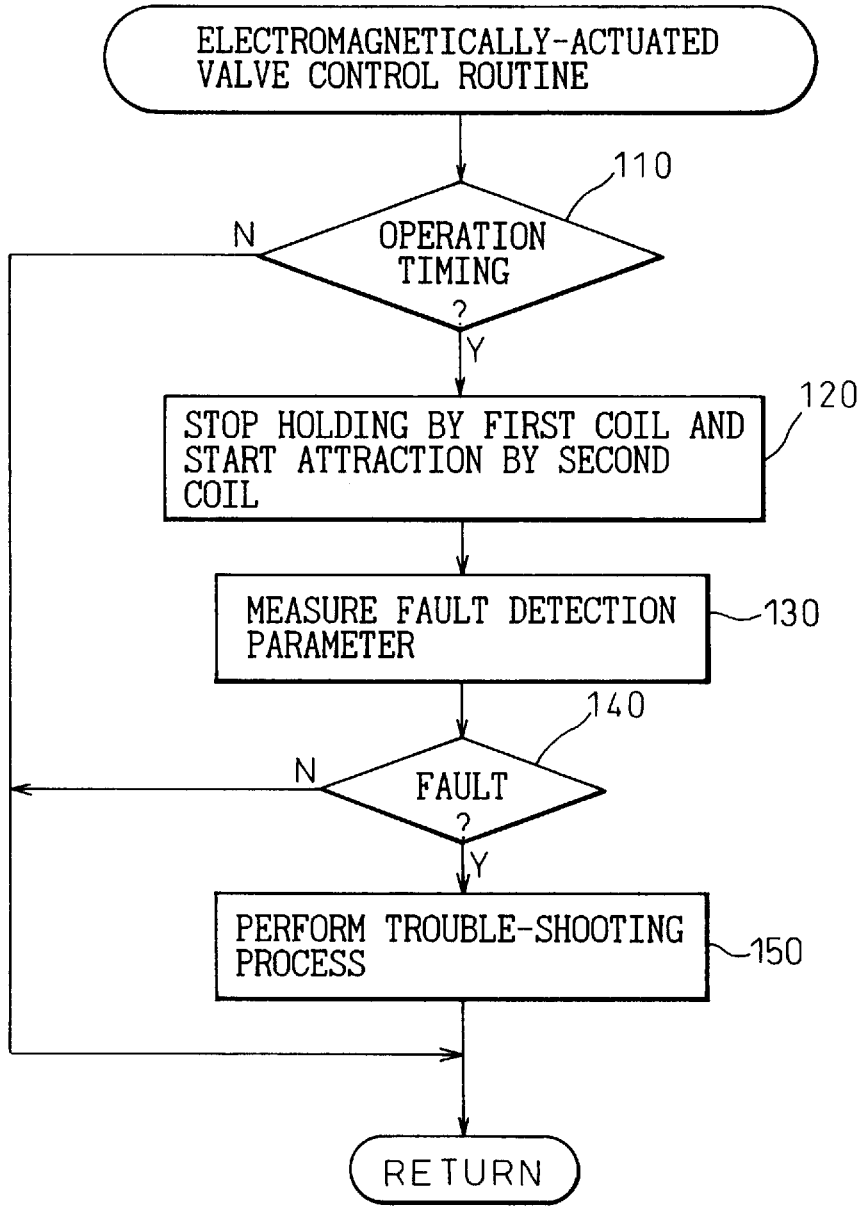
FIG. 10 is a flowchart showing the steps of operation for the electromagnetically-actuated valve control routine.

FIG. 10 is a flowchart showing the steps of a routine for controlling the electromagnetically-actuated valve by the engine ECU 60 for detecting a fault. This routine is configured to be executed for each predetermined crank angle. First, step 110 decides whether the present crank angle indicates the timing for starting the value operation, and if the timing is for operating the valve, the process proceeds to step 120, while when the timing is not for opening or closing the valve, the routine is terminated. Step 120 controls the current as shown in FIGS. 5A, 5B, 5C or 6A, 6B, 6C in order to terminate the holding of the plunger by one coil and start the attraction by the other coil.

Then, step 130 measures the time or the current value providing a parameter for fault detection described above with reference to FIGS. 7A to 7D, 8A to 8D or 9A to 9D. Then, step 140 compares the parameter with a predetermined threshold value thereby to decide the presence or absence of an operation fault of the electromagnetically-actuated valve. If the decision that there is no fault, this routine is terminated, while if the presence of a fault is decided on, the process proceeds to step 150, where a predetermined troubleshooting process is executed and the routine is terminated.

Figures 11A, 11B, 11C:
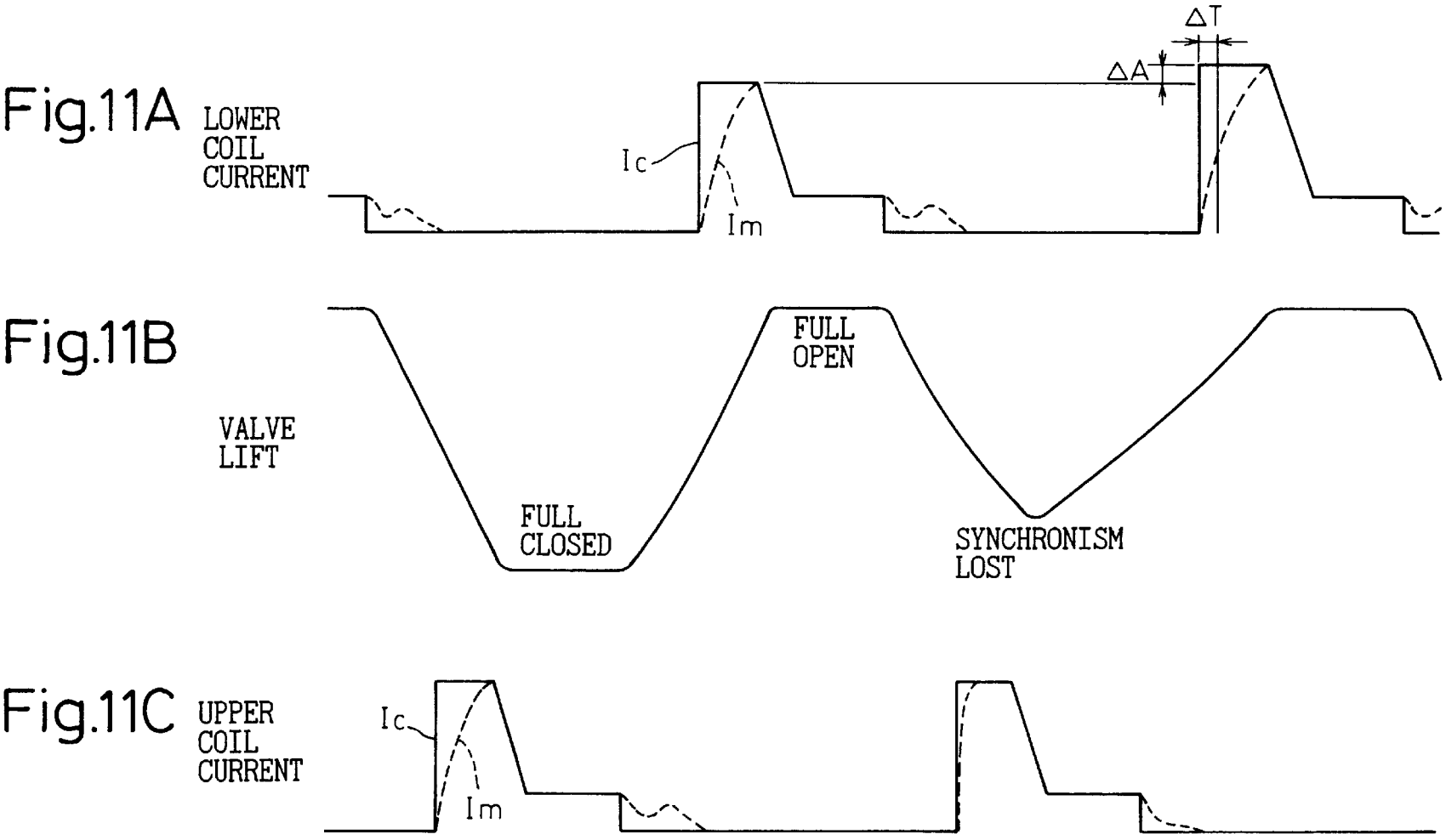
FIGS. 11A, 11B and 11C are time charts showing a lower coil command current, a valve lift and an upper coil command current, respectively, for explaining a trouble-shooting process.

The trouble-shooting process is executed, for example, by changing the command current value when supplying the attraction current to the coil other than that where the loss of synchronism is detected, as shown in FIGS. 11A to 11C upon detection of a fault by the method of FIGS. 9A to 9D. Specifically, the attraction current (peak current) is increased by AA or the attraction current begins to be applied AT earlier. Then, the plunger, i.e., the valve body restores the normal operation. The attraction current can be increased at the same time that the time of starting the application of the attraction current is advanced.

It will thus be understood from the foregoing description that, according to this invention, the ability of the actual coil current to follow the command current in the process of transition from the attracted and held state to the unattracted state or the ability of the actual coil current to follow the command current in starting the attraction can be determined, so that a faulty valve operation can be detected with high accuracy without any independent fault detection means.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of detecting a fault of an electromagnetically-actuated intake/exhaust valve wherein an electromagnetic force generated by supplying a current to first and second coils arranged on opposite sides of a plunger integrated with the valve body is exerted on the plunger thereby to operate the valve, wherein an elastic member biases the valve body toward a neutral position in which the plunger is supported between the first and second coils, the method comprising the steps of:

supplying a command current to the first coil to hold the plunger in a first position adjacent to the first coil;

changing the command current supplied to the first coil to move the plunger away from the first position to a second position adjacent to the second coil;

detecting a change in an amount of current flowing in the first coil after the command current has been changed;

determining whether the operation of the valve is faulty based on the change of the current flowing through the first coil after the command current has been changed.

2. A method according to claim 1, wherein the command current is supplied to the first coil via a coil drive circuit and wherein the determination as to whether the valve is faulty is based on a time delay from a first time point when the command current is changed to reduce the current flowing in the first coil by a predetermined amount to a second time point when the current flowing in the first coil reaches a predetermined value corresponding to the predetermined amount of reduction of the command current.

3. A method according to claim 1, wherein the command current is supplied to the first coil via a coil drive circuit and wherein the command current is changed to reduce the current flowing through the first coil by a predetermined amount and the determination as to whether the valve is faulty is based on a difference between the command current and the actual current flowing in the first coil after the command current has been changed.

4. A method of detecting a fault of an electromagnetically-actuated intake/exhaust valve wherein an electromagnetic force generated by supplying a current to first and second coils arranged on opposite sides of a plunger integrated with the valve body is exerted on the plunger thereby to operate the valve, wherein an elastic member biases the valve body toward a neutral position in which the plunger is supported between the first and second coils, the method comprising the steps of:

supplying a first command current to the first coil to hold the plunger in a first position adjacent to the first coil;

changing the first command current supplied to the first coil to move the plunger away from the first position to a second position adjacent to the second coil;

supplying a second command current to the second coil to attract the plunger to the second position;

detecting a rise time required for the current flowing in the second coil to rise a predetermined amount corresponding to a magnitude of the second command current;

determining whether the operation of the valve is faulty based on the rise time.

* * * * *